US005987904A

United States Patent [19]

Kim et al.

[11] Patent Number: 5,987,904

[45] Date of Patent: Nov. 23, 1999

[54] REFRIGERATOR WITH A DEVICE FOR OPENING/CLOSING COOL AIR DISCHARGE PORTS

[75] Inventors: Jae-in Kim, Seoul; Jun-dong Ji, Suwon, both of Rep. of Korea

[73] Assignee: Samsung Electronics Co., Ltd., Suwon, Rep. of Korea

[21] Appl. No.: 09/053,952

[22] Filed: Apr. 3, 1998

[30] Foreign Application Priority Data

Apr. 18, 1997 [KR] Rep. of Korea ..... 97-14297
Jul. 26, 1997 [KR] Rep. of Korea ..... 97-35334

[51] Int. Cl.[6] ..... F25D 17/08

[52] U.S. Cl. ..... 62/131; 62/186; 62/187; 62/276

[58] Field of Search ..... 62/131, 151, 152, 62/153, 186, 187, 275, 276, 277, 278, 279

[56] References Cited

U.S. PATENT DOCUMENTS

| | | | |
|---|---|---|---|
| 2,527,368 | 10/1950 | McGrath | 62/275 X |
| 3,126,716 | 3/1964 | De Witte | 62/187 X |
| 3,425,236 | 2/1969 | Steed et al. | 62/186 X |
| 4,569,206 | 2/1986 | Mitani et al. | 62/276 X |
| 5,490,394 | 2/1996 | Marques et al. | 62/131 X |

*Primary Examiner*—Harry B. Tanner
*Attorney, Agent, or Firm*—Burns, Doane, Swecker & Mathis, L.L.P.

[57] ABSTRACT

A refrigerator which has a device for opening/closing cool air discharge ports is disclosed. The device includes plates for opening/closing the ports, and an operation member having racks for driving the plates, and a motor for driving the operation member. The heat exchange between an evaporator and the outside warm air is prevented during the defrosting operation and when a door is open. Hence the cooling efficiency is enhanced and the frost caused by the outside warm air is not generated on the evaporated.

4 Claims, 6 Drawing Sheets

REFRIGERATOR WITH A DEVICE FOR OPENING/CLOSING COOL AIR DISCHARGE PORTS

BACKGROUND OF THE INVENTION

1. Field of the Invention

The present invention relates to a refrigerator, and more particularly, to a refrigerator having a device for opening/closing cool air discharge ports during a defrosting operation and/or when a door is open.

2. Related Art

As shown in FIG. 1, a general refrigerator has a body 14 forming a freezing compartment 15 and a fresh food compartment 1, doors 16 and 12 for opening/closing the freezing compartment 15 and the fresh food compartment 1 respectively, a compressor 19 for compressing refrigerant, an evaporator 11 for generating cool air by evaporating the refrigerant supplied from the compressor 19, and a fan 20 for blowing the cool air generated by the evaporator 11.

A duct member 3 for forming a cool air duct 2 is installed at the rear part of the fresh food compartment 1. The duct member 3 has a plurality of cool air discharge ports 3*a* opened in the fresh food compartment 1. The cool air blown by the fan 20 flows into the cool air duct 2, and then is discharged into the fresh food compartment 1 through the cool air discharge ports 3*a*. In the cool air duct 2, a guide device 13 for guiding the cool air flowing into the cool air duct 2 toward the cool air discharge ports 3*a* is installed.

While the refrigerator operates, frost is generated on the evaporator 11. The cooling efficiency of the evaporator 11 is lowered by the frost. Hence, the refrigerator is equipped with a heater 17 for removing the frost, and performs defrosting operation by heating the evaporator 11 using the heater 17 when the refrigerator is used more than a predetermined period of time.

In such a conventional refrigerator, there is a problem that the heat generated by the heater 17 during the defrosting operation is transmitted into the fresh food compartment 1. The heat generated by the heater 17 is mainly transmitted through the same path with the path for supplying the cool air. That is, the heat is mainly transmitted to the fresh food compartment 1 through the cool air duct 2 and the cool air discharge ports 3*a*. Due to the heat transmitted to the fresh food compartment 1, the cooling efficiency of the fresh food compartment 1 is lowered, and the status of the food stored therein cannot be maintained properly.

Furthermore, when a user opens the door 12 of the fresh food compartment 1, the outside warm air flows into the fresh food compartment 1, which mainly flows into the area adjacent to the evaporator 11. When the outside air flows toward the evaporator 11, the frost is generated much more on the evaporator 11. Then, the defrosting operation should be performed more frequently. The heater 17 must be operated in order to perform the defrosting operation, so the cooling efficiency is still more lowered by the frequent defrosting.

SUMMARY OF THE INVENTION

The present invention has been proposed to overcome the above described problems in the prior art, and accordingly it is the object of the present invention to provide a refrigerator which can prevent the transmission of heat generated by a heater into a cooling compartment during the defrosting operation, and prevent the inflow of outside warm air toward an evaporator when the door is open.

To achieve the above object, the present invention provides a refrigerator comprising: a door for opening/closing a cooling compartment; an evaporator for generating cool air to be supplied into the cooling compartment by evaporating refrigerant; a heater for removing frost generated on the evaporator; a duct member forming a cool air duct for guiding the cool air generated from the evaporator, the duct member being formed with a plurality of cool air discharge ports opened in the cooling compartment; an operation member having a pair of racks disposed in parallel with each other, the racks being formed with gear parts respectively at sides facing to each other; plates being installed at areas adjacent to the cool air discharge ports respectively, the plates pivoting by the movement of the operation member, the plates for opening/closing the cool air discharge ports according to a pivoting position; a driving member being disposed between the racks, the driving member being formed with a gear part engaged selectively with the gear parts of the racks according to a rotated position thereof; and a driving motor for rotating the driving member so that the cool air discharge ports are closed during a defrosting operation of the heater and/or when the door is open.

The plate is hingedly mounted at an edge of the cool air discharge port. Support protrusions protrude at a part of the operation member. The support protrusions support the plates so that the plates open the cool air discharge ports when the operation member is moved down, and the plates close the cool air discharge ports when the operation member is moved up.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
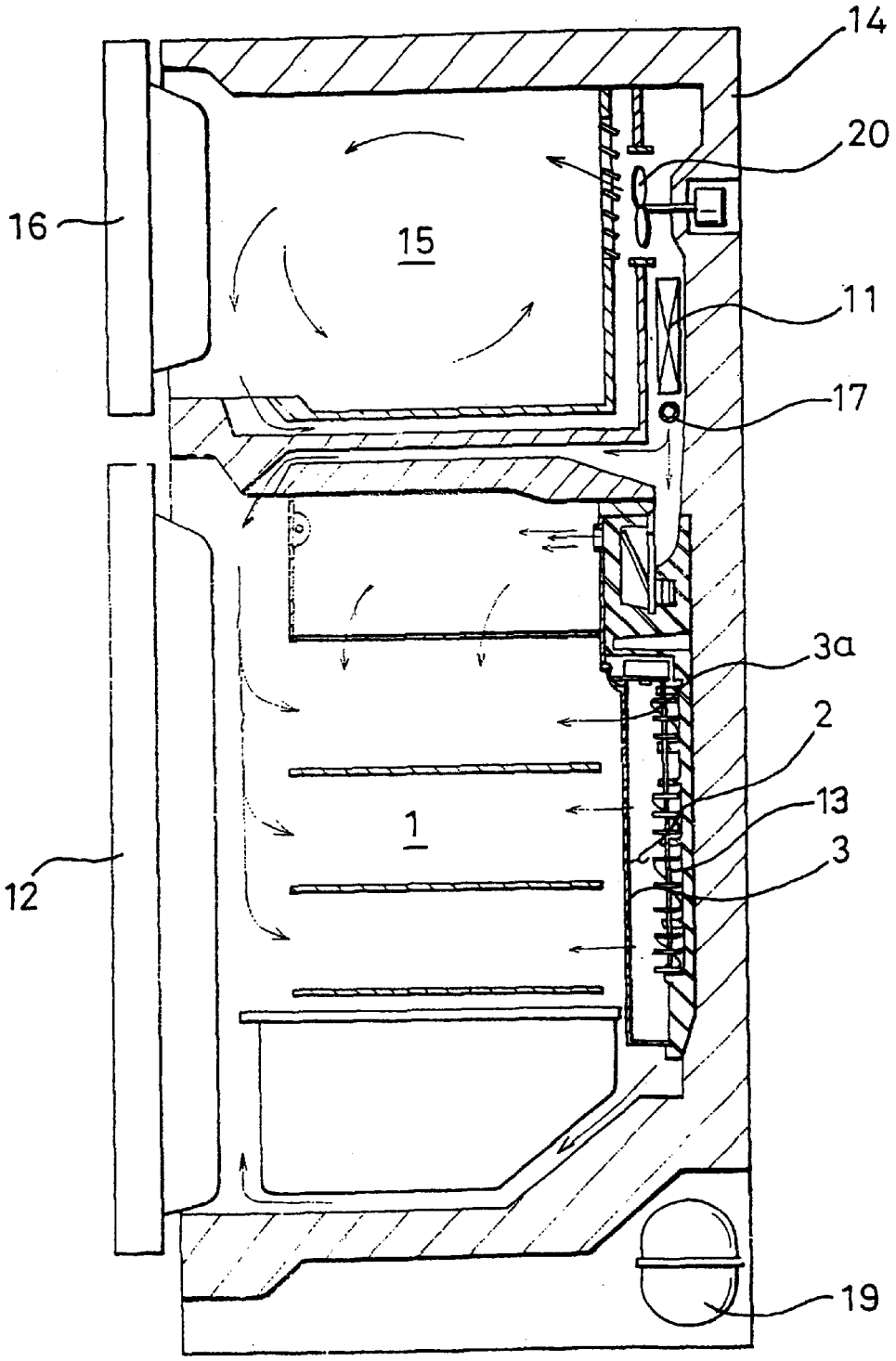
FIG. 1 (PRIOR ART)
FIG. 1 is a side sectional view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
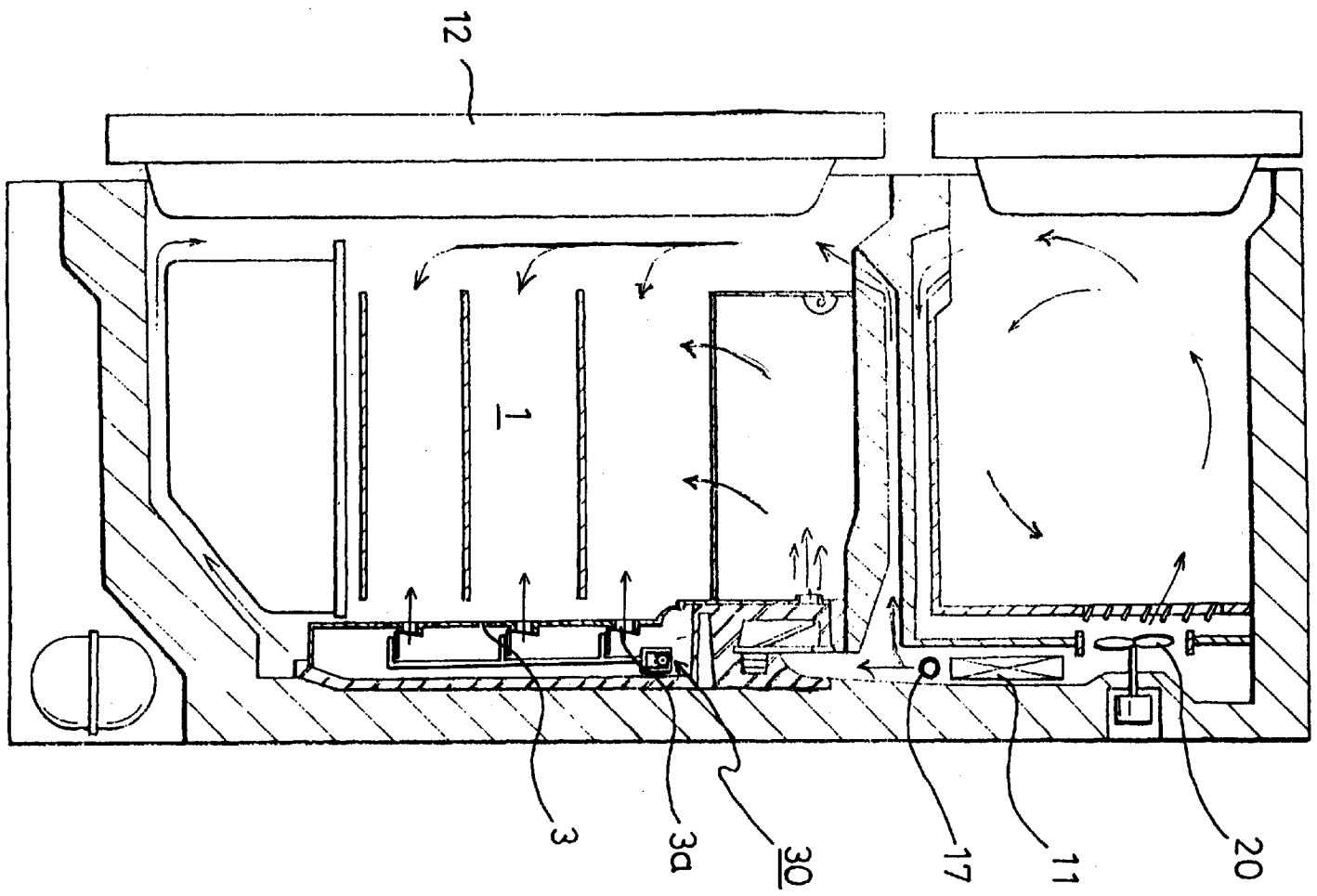
FIG. 2 is a side sectional view of a refrigerator according to the present invention.
Figure 3:
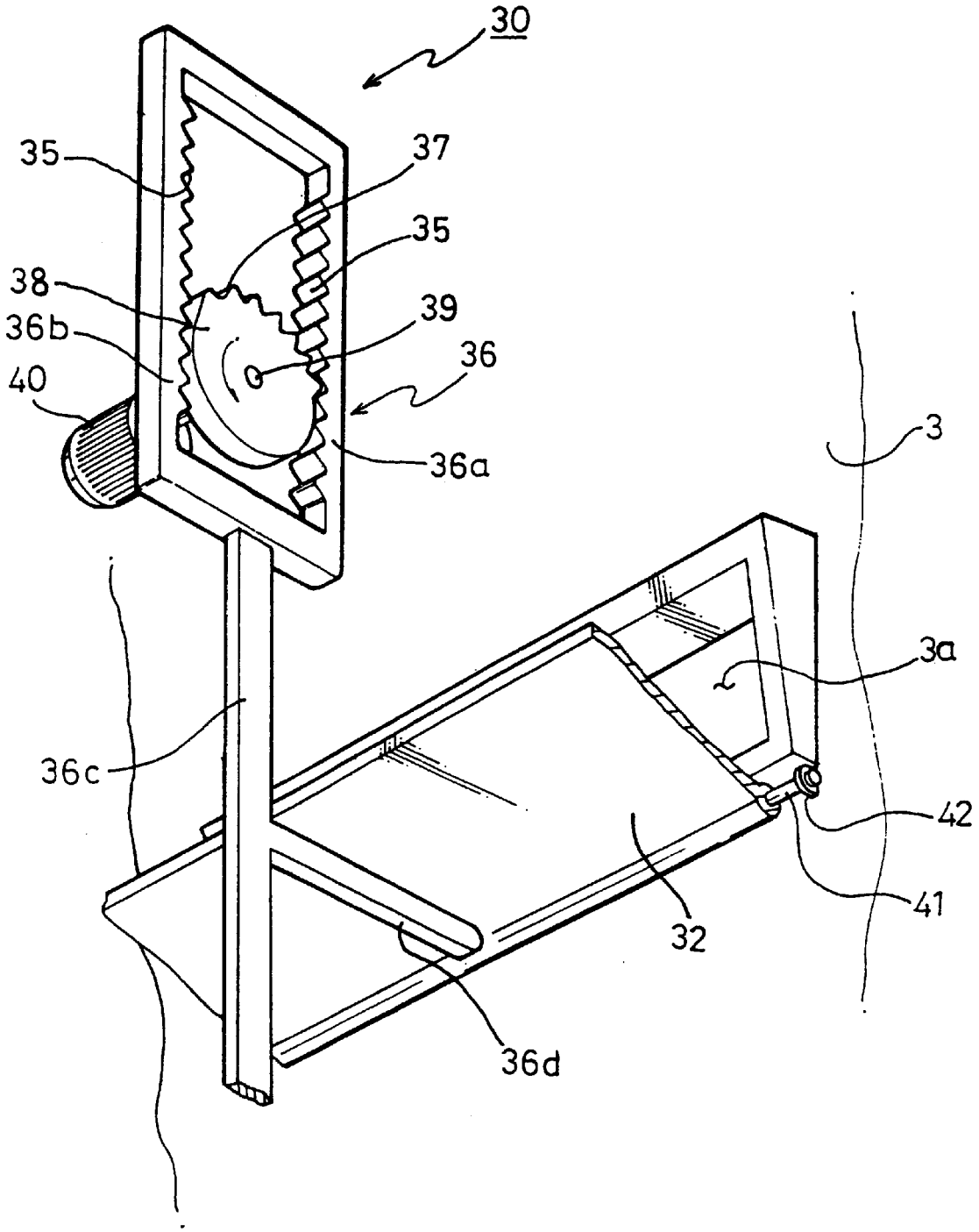
FIG. 3 is an enlarged perspective view of an opening/closing device shown in FIG. 2.
Figure 4:
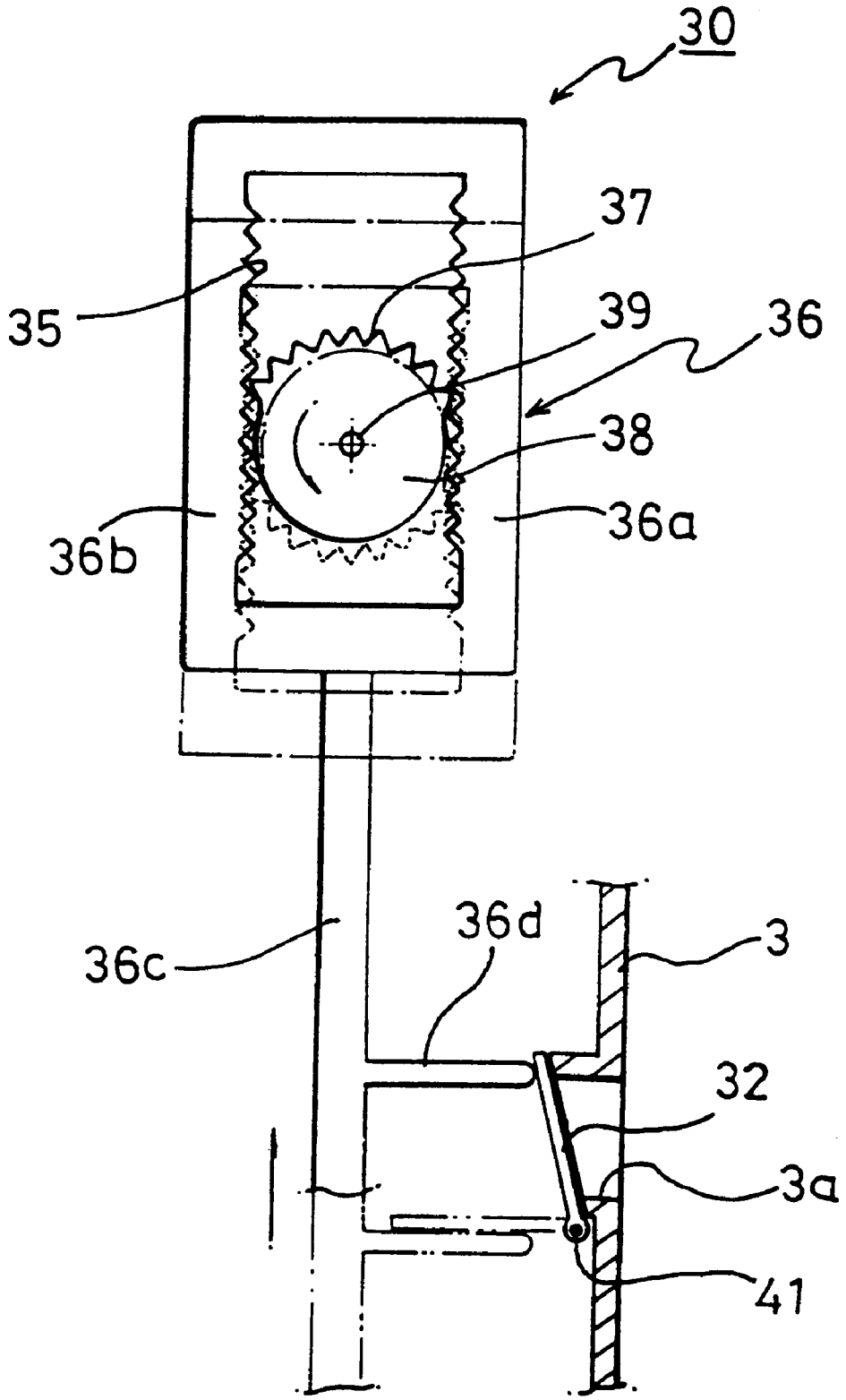
FIG. 4 is a side sectional view of FIG. 3.

FIG. 2 is a side sectional view of a refrigerator according to the present invention, and FIGS. 3 and 4 are enlarged views of an opening/closing device shown in FIG. 2. In the cool air duct 2, an opening/closing device 30 for opening/closing the cool air discharge ports 3*a* is installed.

The opening/closing device 30 includes a driving motor 40 installed in the cool air duct 2, a driving member 38 being rotated by the driving motor 40, an operation member 36 being operated by the driving member 38, and a plurality of plates 32 being operated by the operation member 36.

Brackets 42 are formed at both ends of the lower edge of the cool air discharge port 3*a*, and a hinge pin 41 is fixed by the brackets 42. The plate 32 is hingedly mounted on the edge part of the cool air discharge port 3*a* by the hinge pin 41. The plates 32 open/close the cool air discharge ports 3*a* according to a pivoting position thereof.

The operation member 36 has a pair of racks 36*a* and 36*b* which are disposed in parallel with each other. Each of the racks 36*a* and 36*b* is formed with a gear part 35 at an inner side facing to each other. Furthermore, the operation member 36 has an operation rod 36*c* extended downward therefrom.

Support protrusions 36*d* protrude at a part of the operation rod 36*c*. The support protrusions 36*d* support the plates 32. The plates 32 are supported by the support protrusions 36*d* so that the cool air discharge ports 3*a* are opened when the operation rod 36*c* is moved down as shown in FIG. 3, and the cool air discharge ports 3*a* are closed when the operation rod 36*c* is moved up as shown in FIG. 4.

The driving member 38 is connected to the rotational shaft 39 of the driving motor 40. At a part of the periphery of the driving member 38, a gear part 37 is formed. The gear part 37 is formed over less than a half area of the periphery of the driving member 38. The driving member 38 is disposed between the racks 36*a* and 36*b*, and the gear par 37 of the driving member 38 is engaged with the gear parts 35 of the racks 36*a* and 36*b*. In this situation, since the gear part 37 of the driving member 38 is formed over less than a half area of the periphery of the driving member 38, the driving member 38 is selectively tooth-engaged with one of the racks 36*a* and 36*b*.

While the refrigerator operates, the driving motor 40 is driven by a control part (not shown) to rotate the driving member 38 in a counterclockwise direction. Then the driving motor 38 is engaged with the left rack 36*b*, and thereby the operation member 36 is moved down. When the operation member 36 is moved down, the plates 32 which have been supported by the supporting protrusions 36*d* pivot downward, whereby the cool air discharge ports 3*a* are opened as shown in FIG. 3.

When the defrosting operation of the refrigerator begins, the driving motor 40 rotates the driving member 38 in a counterclockwise direction again. Then the driving member 38 is engaged with the right rack 36*a*, and thereby the operation member 36 is moved up. When the operation member 36 is moved up, the plates 32 pivot upward, whereby the cool air discharge ports 3*a* are closed as shown in FIG. 4.

Furthermore, during the operation of the refrigerator, when a user opens the door 12, the opening of door 12 is sensed by a sensor for use in sensing the opening/closing of the door 12, and then the control part drives the driving motor 40 to close the cool air discharge ports 3*a* as described above.

Since the cool air discharge ports 3*a* are closed during the defrosting operation that the heater 17 generates heat and/or when the door 12 is open, the transmission of the heat from the heater 17 to the fresh food compartment 1 and the transmission of the outside warm air to the evaporator 11 are prevented. Therefore, the lowering of the cooling efficiency of the fresh food compartment 1 is prevented, and the frost caused by the outside warm air is not generated on the evaporator 11.

Furthermore, according to the present invention, all of the opening operation and the closing operation of the plates 32 are controlled by the rotation of the driving member 38 in only one rotational direction. In other words, when the driving member 38 is rotated by the driving motor 40, the operation member 36 is moved up and down repeatedly. Therefore, there is an additional advantage that the opening and closing operations of the plates 32 can be controlled by a motor capable of rotating in only one direction without a motor capable of rotating in bilateral directions.

Figure 5:
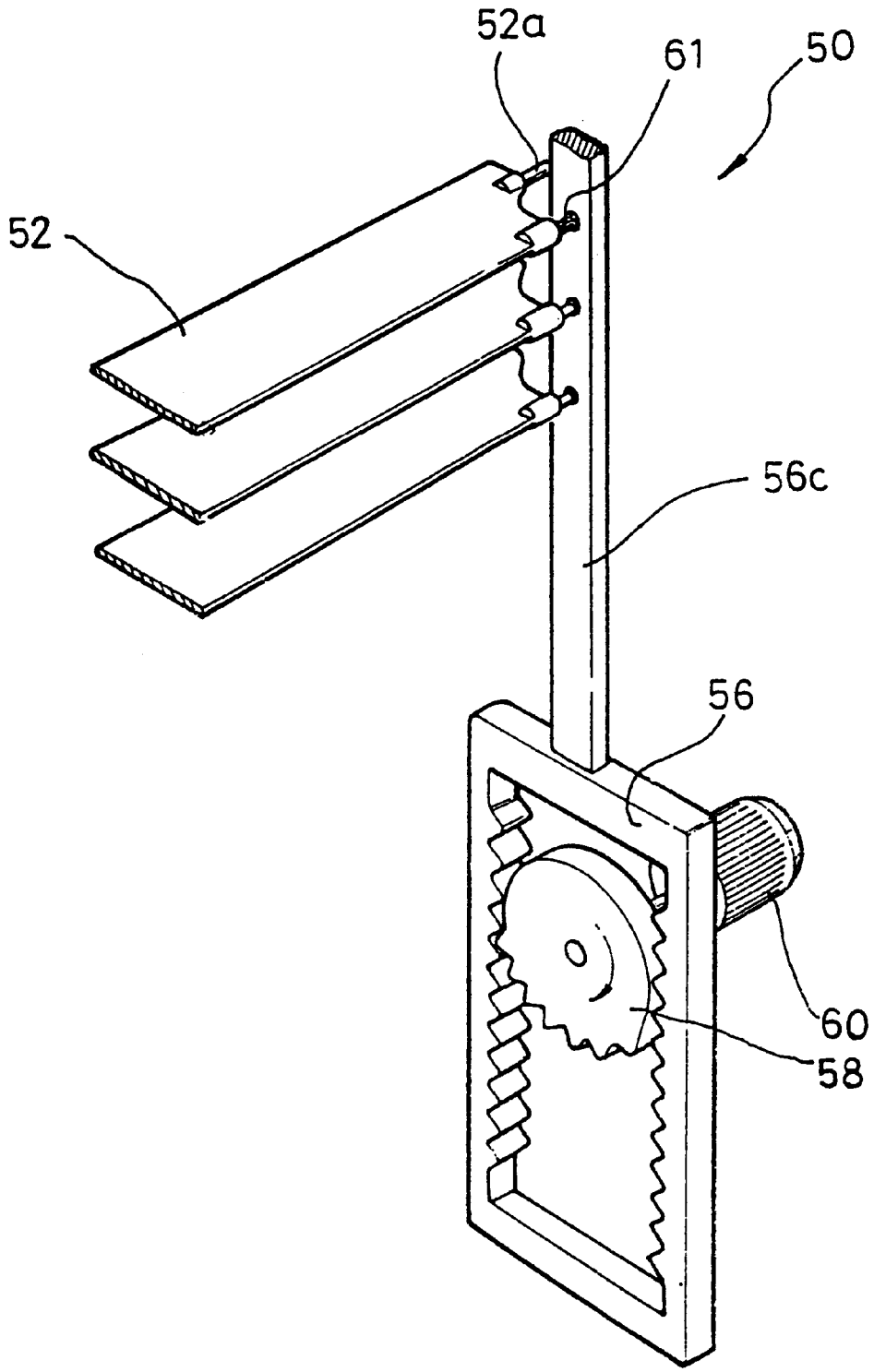
FIG. 5 is another embodiment of the opening/closing device according to the present invention.
Figure 6:
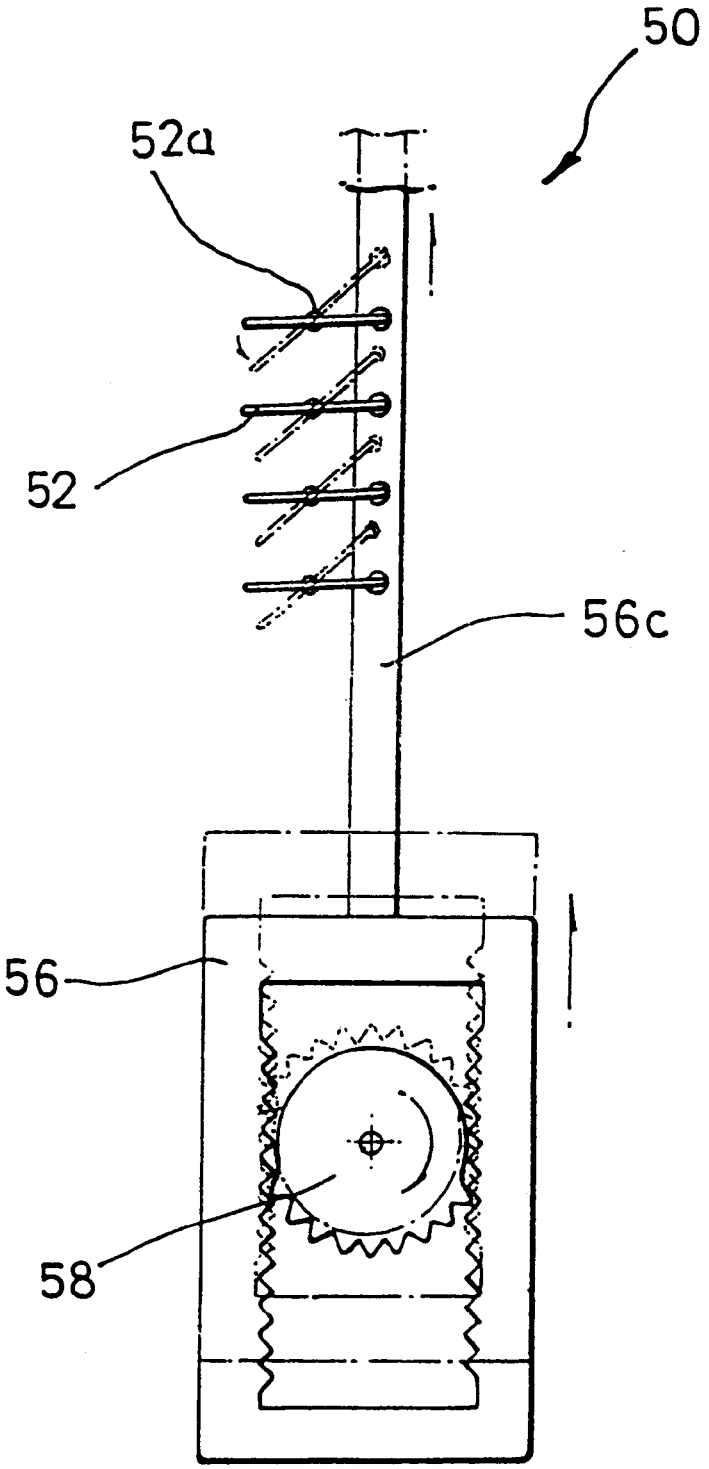
FIG. 6 is a side sectional view of FIG. 5.

FIG. 5 is another embodiment of the present invention which shows the opening/closing device 50, and FIG. 6 is a side sectional view of FIG. 5.

In the present embodiment, the construction and the operation of the driving motor 60, driving member 58, and the operating member 56 are the same with those of the embodiment shown in FIGS. 2 through 4.

The plates 52 are fixed by pivoting pins 52*a* at predetermined positions to be capable of pivoting. The plates 52 open/close the cool air discharge ports 3*a* according to a pivoting position thereof. A pivoting pin 61 is installed at the edge part of the plate 52. The pivoting pin 61 is assembled with the operation rod 56*c* of the operation member 56. When the driving motor 60 operates to move the operation member 56 up, the plates 52 pivot as shown in FIG. 6, and thereby the cool air discharge ports 3*a* are closed. When the operation member 56 moves down, the plates 52 pivot as shown in FIG. 5, and thereby the cool air discharge ports 3*a* are opened.

The operation of the refrigerator having the opening/closing device according to the present embodiment is similar to that of the embodiment shown in FIGS. 2 through 4. That is, when the door 12 is opened or the defrosting operation of the evaporator 11 is performed by the heater 17, the driving motor 60 is driven by the control part (not shown) so that the cool air discharge ports 3*a* are closed by the plates 52.

As described above, according to the present invention, since the heat exchange between the evaporator and the outside warm air is prevented during the defrosting operation and when the door is open, the cooling efficiency is enhanced and the frost caused by the outside warm air is not generated on the evaporated.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a door for opening/closing a cooling compartment;

an evaporator for generating cool air to be supplied into said cooling compartment by evaporating refrigerant;

a heater for removing frost generated on said evaporator;

a duct member forming a cool air duct for guiding the cool air generated from said evaporator, said duct member being formed with a plurality of cool air discharge ports opened in said cooling compartment;

an operation member having a pair of racks disposed in parallel with each other, said racks being formed with gear parts respectively at sides facing to each other;

plates being installed at areas adjacent to the cool air discharge ports respectively, said plates pivoting by the movement of said operation member, said plates for opening/closing the cool air discharge ports according to a pivoting position;

a driving member being disposed between said racks, said driving member being formed with a gear part engaged selectively with the gear parts of said racks according to a rotated position thereof; and a driving motor for rotating said driving member so that the cool air discharge ports are closed during a defrosting operation of said heater and/or when said door is open.

2. The refrigerator as claimed in claim 1, wherein said plate is hingedly mounted at an edge of the cool air discharge port.

3. The refrigerator as claimed in claim 2, further comprising support protrusions protruding at a part of said operation member, said support protrusions for supporting said plates so that said plates open the cool air discharge ports when said operation member is moved down, and said plates close the cool air discharge ports when said operation member is moved up.

4. The refrigerator as claimed in claim 1, wherein said plates are connected to said operation member to be capable of pivoting.

* * * * *